United States Patent [19]

Nitschmann et al.

[11] 4,434,556

[45] Mar. 6, 1984

[54] ARRANGEMENT FOR LUBRICATING SAW CHAINS OF POWER SAWS

[75] Inventors: Karl Nitschmann, Schorndorf; Günther Weyda, Waiblinge-Hohenacker; Bodo Emmrich, Stuttgart; Karl O. Stimpfig, Waiblingen-Beinstein, all of Fed. Rep. of Germany

[73] Assignee: Andreas Stihl, Waiblingen, Fed. Rep. of Germany

[21] Appl. No.: 254,614

[22] Filed: Apr. 16, 1981

[30] Foreign Application Priority Data

Apr. 30, 1980 [DE] Fed. Rep. of Germany ..... 3016596

[51] Int. Cl.[3] ..... B27B 17/12

[52] U.S. Cl. ..... 30/123.4; 83/169; 83/830; 184/15.1

[58] Field of Search ..... 83/830, 831, 832, 833, 83/834, 169; 30/123.4; 184/15 R

[56] References Cited

U.S. PATENT DOCUMENTS

| | | | |
|---|---|---|---|
| 1,397,026 | 11/1921 | Wolf | 30/123.4 |
| 3,292,670 | 12/1966 | Ratz et al. | 30/123.4 |
| 3,478,787 | 11/1969 | Piller | 30/123.4 |

*Primary Examiner*—Donald R. Schran

*Attorney, Agent, or Firm*—Walter Ottesen

[57] ABSTRACT

An arrangement for lubricating saw chains of power saws. The chains include chip removing members, cutting tooth members, connecting links, and other chain members joined by rivet connections. The extensions of the chip removing members run in a guide bar provided with an oil supply. The chip removing members are provided on at least one of their side surfaces with at least one oil guide in the form of a groove in the side surface, which guide extends counter to the running direction of the saw chain and at an incline upwardly toward the rivet connections. The oil guide merges into an oil channel which with at least one of its ends is located in the vicinity or close range of a rivet hole.

14 Claims, 7 Drawing Figures

ARRANGEMENT FOR LUBRICATING SAW CHAINS OF POWER SAWS

BACKGROUND OF THE INVENTION

The present invention relates to an arrangement for lubricating saw chains of power chain saws, which have saw chains with chip removing members, cutting-tooth members, connecting links, and other chain members connected to each other by means of rivet connections. The extensions of the chip removing members run in a guide bar provided with an oil supply. The chip removing members are provided on at least one of their side surfaces with at least one oil guide in the form of a groove in the side surface, with such oil guide extending counter to the running direction of the saw chain and at an incline upwardly toward the rivet connections.

An arrangement for lubricating a saw chain of this type is disclosed by U.S. Pat. No. 3,478,787 Piller, issued Nov. 18, 1969, which provides means by which oil delivered from the bar or blade of a chain saw into the peripheral saw chain channel or the bar will, upon rapid travel of the saw chain, automatically cause oil to pass to the pivot pin in the saw chain links where lubrication need is the greatest. In this prior art, the chip removing members are provided with two oil guides embodied separately from each other, so that the lubricant is conveyed only separately and in such quantity to the rivet connections as made available at the mouth or opening of the particular oil guide. The lubricant reaches the rivet at only one location, and is only supplied in a narrow region to the surface to be lubricated between the connecting link or the cutting tooth member and the chip removing member. The lubricant distributes itself upon the surface and around the rivet during the operation mostly due to the movement of the contact surfaces of the members relative to each other, or due to the movement of the rivet in the chip removing member. The separate supply of lubricant to each individual rivet connection has the disadvantage that the opening or mouth located closest to the bottom of the guide bar has available a greater quantity of lubricant than does the mouth or opening of the oil guide for the other rivet connection of the same chip removing member located thereabove.

The more sparcely lubricated rivet connection is subjected to greater wear and possibly becomes more difficult to move, which also influences the durability of the adjoining rivet connections.

SUMMARY OF THE INVENTION

It is an object of the present invention to provide an arrangement, for lubricating saw chains of power saws of the foregoing type, which guides the lubricant substantially uniformly into all regions to be lubricated, and which assures that with saw chains operated at high circulating speeds the rivet connecting areas of all chain links are, during operation of the saw, continuously and as uniformly as possible provided with lubricant. The chain is to have lubricant available thereto at all times for the lubrication of the connecting areas.

The arrangement of the present invention is characterized primarily in that the oil guide is extended into an oil channel which is located with at least one of its ends in the vicinity or close range of a rivet hole. By inventively providing an oil channel, or by further development of the oil guide into an oil channel, lubricant can by means of one oil supply channel be supplied to both rivet connections of a given chip removing member. Accordingly, lubricant uniformly reaches into the contact region between the connecting link or cutting tooth link, and the chip removing member. Furthermore, lubricant is always available in the oil channel, even when the lubricant supply is briefly interrupted. Consequently, there exists a certain lubricant reserve in the region of the oil channel.

By the provision of one single mouth or opening at the lower end of the chip removing member, with such mouth or opening being adjacent to the bottom of the guide bar, there is attained that the lubricant always reaches the mouth or opening of the oil guide and is forced thereinto.

In an advantageous arrangement of the features of the present invention, the oil guide tapers in a wedge shape from the mouth to the rivet connections forming the areas to be lubricated. A certain acceleration of the lubricant penetrating from the oil guide into the areas to be lubricated is attained by this feature, and it is assured that even with strongly loaded chains, the lubricating oil reaches the immediate region of the rivet connection. The loading capability and the durability of the chain is increased by this arrangement of the present invention, without requiring extensive measures to be undertaken which would increase the production costs.

An advantageous further embodiment of the present inventive arrangement is obtained when the oil channel is embodied as a full circle which surrounds the rivet hole. The contact surface is directly supplied with lubricant over a wide area, so that a lubrication of the rivet connection is always assured independently of the circulating speed of the chain.

The oil channel can be spaced from the rivet hole or, for the purpose of being able to supply lubricant directly to the rivet, the oil passage or channel can also be advantageously provided at the rivet hole in such a manner that it is delimited radially inwardly by the rivet of the rivet connection. If such an oil channel is advantageously embodied as a full circle, an extensive lubrication of the rivet in the chip removal member is assured.

For the purpose of assuring sufficient lubrication of all rivet connections even when individual opening holes are entirely or partially clogged up by chips or other contaminants, the connecting links and/or cutting tooth members connecting the chip removing members can be provided with a grooving or chamfering which respectively connects the adjoining oil channels of two successive chip removing members in a lubricant-conveying manner. In this way the lubricant can pass from a not yet clogged up opening of an oil guide via its own lubricating location to the next lubricating location of the next chain link if the original connection associated therewith should be blocked by chips or the like. Such a lubricant connection system assures that even during disadvantageous operating conditions a sufficient lubrication of all rivet connections is provided.

According to other specific embodiments of the present invention, one end of an oil channel may lie in the vicinity or close range of the first rivet hole, and the other end may lie in the region of the second rivet hole. The oil channel may lie substantially parallel to a plane determined by the axes of the rivet holes, whereby the oil channel is preferably arranged below the plane. Alternatively, one end of a substantially straight oil channel may lie below, and the other end may lie above, the plane determined by the axes of the rivet holes.

The ends of the oil channel may terminate approximately at a vertical line erected on the plane in the axes of the rivet holes.

According to another proposal, the oil channel may surround the rivet hole semicircularly.

The cross section of the oil guide at its narrowest area may be greater than the cross section of the oil channel.

The oil guide, from the mouth or opening, may first lead into a first oil channel, and from this oil channel may lead into a second oil channel provided around a second rivet hole of the chip removing member, the two oil channels communicating with one another by a very short connection embodied as an oil supply channel.

The end regions of the oil channel may embrace the rivet hole along a quarter of a circle and their ends may terminate at the plane determined by the axis of the rivet holes.

The oil channel may be covered at least partially by a chain link connecting the chip removing members.

The connecting links and/or the cutting tooth members may be provided with a groove on that side thereof which faces the chip removing members, and this groove is in communication with the oil channels of the rivet holes of two chip removing members for purposes of supplying lubricant thereto.

Several oil guides may be associated with one oil channel, and these oil guides may open at different locations into the oil channel.

The oil channels and the oil guides of a saw chain may form a lubricant connection system which is supplied at a plurality of locations.

BRIEF DESCRIPTION OF THE DRAWING

The invention will now be described with reference to the drawing wherein.

DESCRIPTION OF THE PREFERRED EMBODIMENTS OF THE INVENTION

Figure 1:
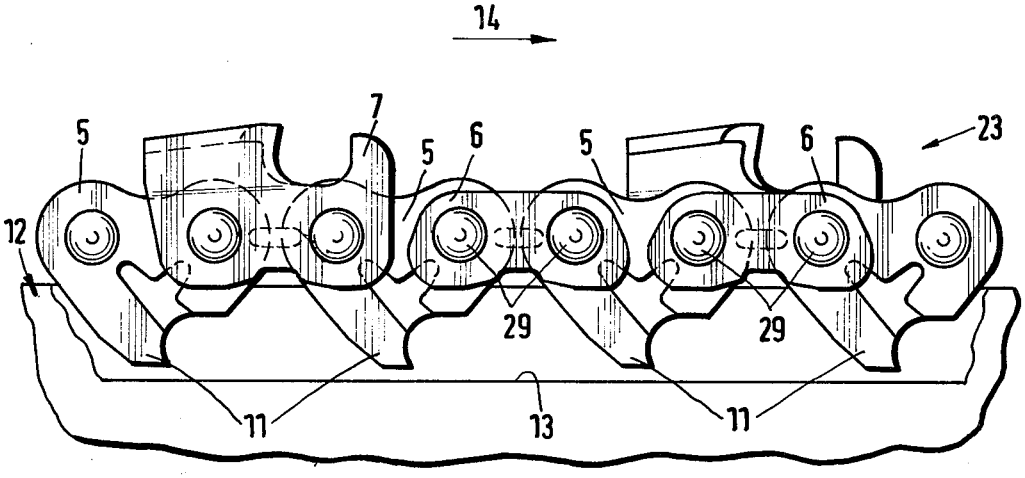
FIG. 1 is a schematic cutaway portion of a saw chain equipped with the saw chain lubricating arrangement according to the invention.
Figure 2:
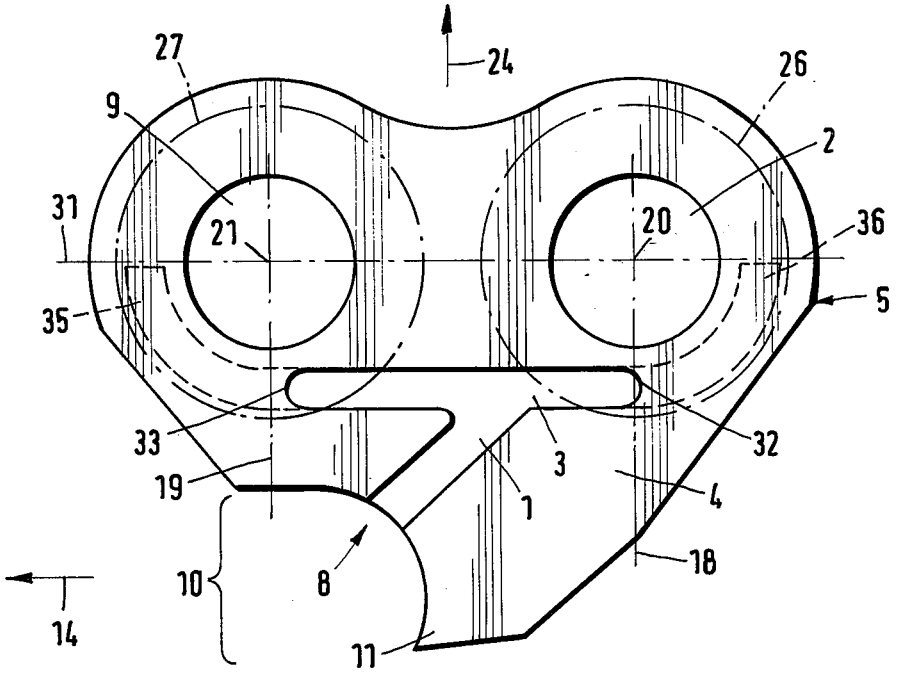
FIG. 2 is a view of a chip removing member with an oil channel according to the invention.

Referring now to the drawings in detail, FIG. 2 shows a chip removing member 5 provided with two pin or rivet holes 2, 9. The lower part 10 of the member 5 is semicircular and forms the region in which the lubricant is received. The lower edge 11 of the chip removing member 5 slides through a known groove formed slightly above the bottom 13 of the guide bar 12 of the saw (FIG. 1). The lubricant in this groove passes, by way of the forward movement in the direction of the arrow 14, into the mouth 8 of the oil guide 1, and is forced into that region of the oil guide 1 which is embodied as an oil passage or channel 3.

The oil channel 3 is so arranged that it is located approximately parallel to a plane 31 defined by the axes 20 and 21 of the rivet holes 2, 9. In the illustrated embodiment, the ends 32, 33 of the oil channel 3 lie approximately on the vertical lines 18, 19 erected in the axes 20, 21 on the plane 31. The ends 32, 33 lie substantially in a close range 26, 27 around the rivet holes 2, 9, so that an adequate lubrication of the rivet connections is assured. Advantageously, the oil channel 3 can be so embodied that its end regions 35, 36, shown in dash lines, surround the rivet holes 2, 9 on a quarter of a circle. The ends 32, 33 then terminate approximately at the central plane 31.

The advantage of this arrangement lies in the favorable utilization of centrifugal forces. The saw chain 23 of FIG. 1 runs in a closed guide bar 12, whereby the reversing regions are to a large extent semicircular. In these regions, the centrifugal force is effective in the direction of the arrow 24 (FIG. 2) upon each particle of the lubricant, so that these particles are correspondingly moved and are conveyed to that region which does not directly adjoin the oil channel 3 or is not connected therewith.

This inventive embodiment accordingly assures that with an oil guide 1, the lubrication of both rivet connections is assured. Due to the provision of the oil channel 3, a certain quantity of lubricant will always be available in the close range 26, 27 of the rivet connections, and the lubricant is also given off to the rivet connections when the oil guide 1 is stopped up or when there is not enough lubricant in the guide bar 12 (FIG. 1).

Figure 3:
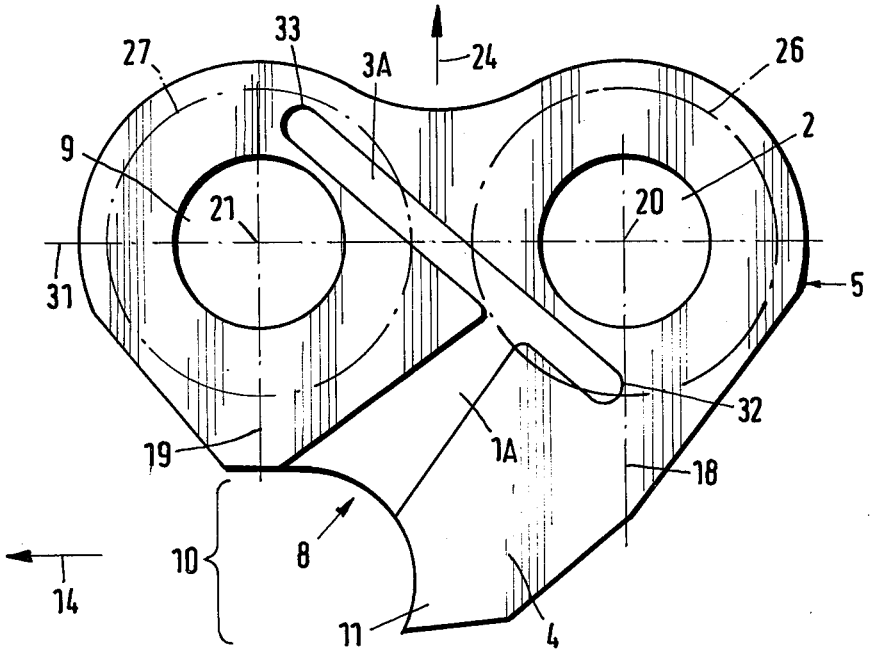
FIG. 3 is a view of a chip removing member with an oil channel in a different position and a conically tapering oil guide.

As shown in FIG. 3, the range of the oil channel 3A is still further increased due to its position, so that it can take up still more lubricant, whereby a greater reserve is available when not enough lubricant is supplied.

In the illustrated embodiment, the oil guide 1A advantageously tapers toward the rivet hole 2, so that the received lubricant is forced at an accelerated speed into the oil channel 3A, where it is delivered under pressure to the rivet connections. Due to the centrifugal force, as well as the relative movement of the connecting links 6 and the cutting members 7 relative to the chip removal member 5 (FIG. 1), the lubricant is distributed in the contact regions which are to be lubricated.

Figure 4:
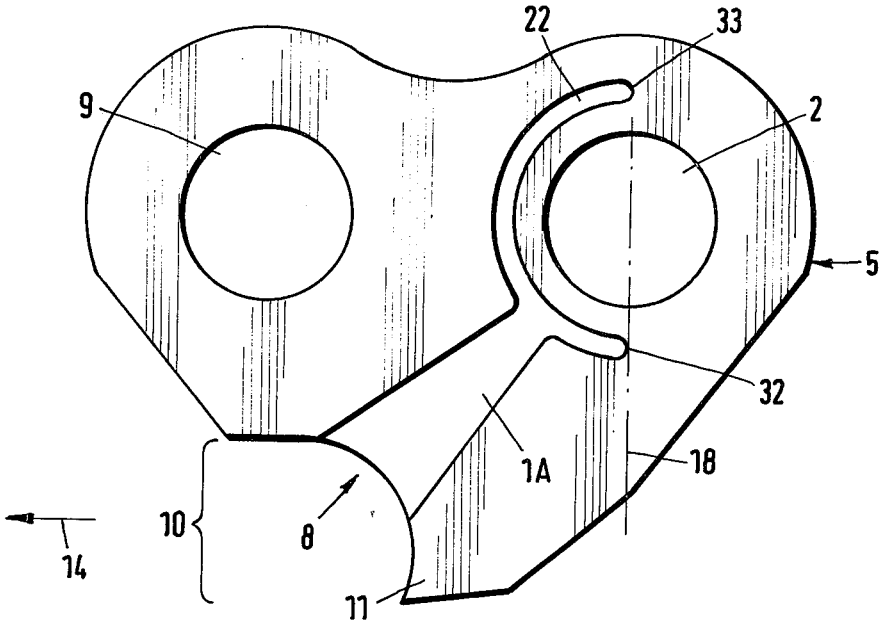
FIG. 4 is a view of a chip removing member with an oil channel embodied as a semicircle.
Figure 5:
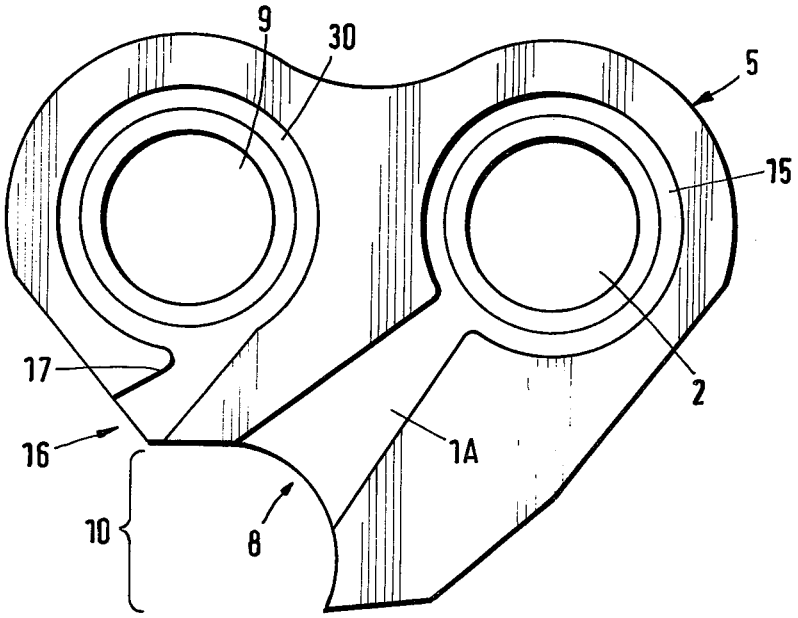
FIG. 5 is a view of a chip removing member with an oil channel embodied as a full circle.

FIGS. 4 and 5 show embodiments of an inventive oil channel in accordance with the present disclosure. The semicircular oil channel 22, which is arranged concentrically with respect to the rivet hole 2, lies on that half side of the rivet hole 2 which faces toward the direction of movement 14. In this way an increased supply of lubricant to the particularly stressed rivet connections can be assured.

As shown in FIG. 5, advantageously an oil channel may be selected which completely concentrically surrounds the rivet hole 2 as a full circle. Consequently, a lubricant supply along substantially the entire contact surface is made possible. For a better understanding, FIG. 5 shows the oil guide 17, which is necessary in this embodiment for lubricating the second rivet connection, and which has its mouth 16 above or at the upper edge of the region 10. The oil guide 17 likewise opens into an oil channel, illustrated in FIG. 5 as a full circle 30. Such a lubricant supply assures easily movable pivot connections which are subjected to minimal wear.

In a non-illustrated embodiment of the present inventive arrangement, the oil channel 15 is delimited radially of the rivet hole by a rivet 29 which is to be inserted, so that lubricant is supplied thereto directly at the peripheral region. The lubricant distribution occurs, as previously already set forth, mostly by movement and acceleration of the individual chain links, or of the lubricant on the chain links.

Figure 6:
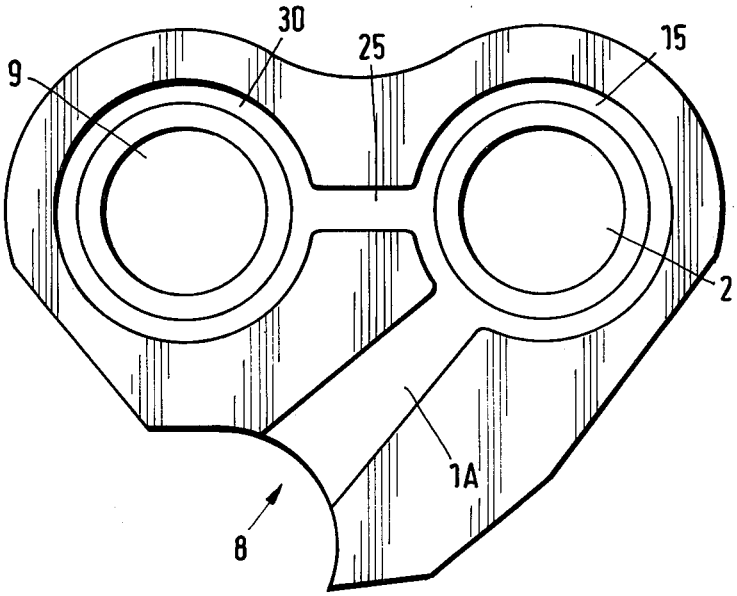
FIG. 6 is a view of a chip removing member according to FIG. 5 with an oil guide connecting the oil channels.

FIG. 6 shows a further inventively embodied advantageous arrangement which, by way of only one oil guide 1A with one mouth or opening region 8, supplies two oil channels embodied as full circles 15, 30, whereby these oil channels are in communication with each other by way of a very short oil supply channel 25. With such an arrangement it must be assured that the oil guide 1 can supply a relatively large quantity of lubricant in order to meet the lubricant requirement of both full circles 15, 30. Particularly this arrangement shows that also a longer interruption of the lubricant supply into the oil guide 1 does not result in an immediate interruption of the lubricant delivery of the oil channels 15, 30, since in these channels a certain volume of lubricant is stored, so to speak, as a reserve. This advantage is applicable for all arrangements according to the present invention.

Figure 7:
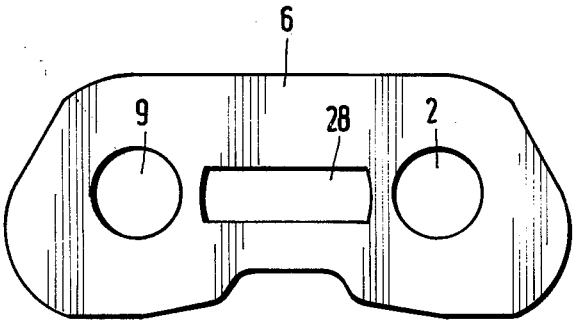
FIG. 7 shows a connecting link or connecting member of the chip removing members, which together with the chip removing members and cutting tooth members, form the saw chain.

The connecting link 7 illustrated in FIG. 7, which cooperates with chip removing members 5, is likewise provided with an oil guide 28. This oil guide 28 comes into lubricant-conveying communication with the oil channel associated with a rivet connection of two chip removing members. Thus it is attained that the oil channel of a member 5, on the one hand, is supplied with lubricant by its associated oil guide, while, on the other hand, it can also be supplied with lubricant by way of the oil guide 28 and the oil channel as well as the oil guide of the adjoining chip removing member. Consequently there is assured that also during temporary clogging-up of a mouth or opening 8 with chips or other contaminants, the transport of lubricant to the next chain link is maintained to a sufficient extent by way of the oil guide 28.

FIG. 1 shows a saw chain provided with the lubricant communication system produced by the present inventive arrangement. The lower sections 11 of the chip removal members 5 slide in the guide bar and take the lubricant out of the groove 13 by their mouths or openings and convey the same to the rivet connections. The rivet connections of adjoining chain links are in communication with each other by way of the oil guide 28 of the connecting link 6 or of the cutting tooth member 7. If the oil guide should clog-up in the region 11 of a chip removing member 5, the lubricant supply to its rivet connections is assured by the adjoining oil guide and the oil guide in the members 6 and 7. Even under disadvantageous operating conditions, a lubrication of the rivet connections can be largely maintained. Consequently, the wear of chains embodied in accordance with the present inventive features is less, and their durability is greater.

The position of the oil guides 1, 1A, 17 can be so provided that they lead very steeply to the rivet holes 2, 9. This has as a consequence that the lubricant is conveyed into the oil guide more by the centrifugal force than by the pressure of the entering lubricant. The situation differs, however, when the oil guides rise only at a small angle. With such a position, the lubricant is forced into the mouths 8, 16 by the chip removal movement of the member 5, so that also with a slowly running chain there occurs relatively reliable conveying of the lubricant. Additionally, also the inertial forces are effective during acceleration of the chain in the direction of the arrow 14 or in the reversing regions of the saw chain. Naturally, the possibilities available with the present inventive arrangement are not restricted to the illustrated and described embodiments. A multiplicity of combinations is conceivable, as for instance two oil channels embodied as semicircles which are supplied by a branching oil guide, whereby the oil guide opens in the lowermost point of the semicircle. Also, an oil supply connection of the two semicircular oil guides arranged around the connecting center holes can be connected by an oil guide respectively opening along the periphery, into which in turn the oil guide coming from the mouth opens.

The present invention is, of course, in no way restricted to the specific disclosure of the specification and drawings, but also encompasses any modifications within the scope of the appended claims.

What we claim is:

1. An arrangement for lubricating the saw chain of a power-driven chain saw having a guide for accommodating and guiding the saw chain, the saw chain including chip-removing members, cutting-tooth members, and connecting members, all of which are respectively provided with two rivet holes, said members being interconnected in a specific pattern by means of rivets and said rivet holes to form rivet connections, said chip-removing members having respective extensions which run in the guide bar provided with an oil supply for lubricating the saw chain, the arrangement comprising:

at least one groove defining an oil guide formed in the side surface of each of said chip-removing members, the oil guide having an inlet opening communicating with the oil supply, the oil guide being disposed in said surface to extend counter to the running direction of the saw chain and to extend at an angle upwardly toward one of the rivet holes;

each of said chip-removing members further having at least one oil channel formed in said side surface and communicating with the end of said oil guide remote from said inlet opening; said oil channel of each of said chip-removing members being at least partially covered by a member of the saw chain connected to the chip-removing member; and, said oil channel having two ends, one end of said channel being located in the vicinity of one of the rivet holes, and the other end of the channel being located in the vicinity of the other one of said rivet holes whereby oil from said oil guide is directed to both of said rivet holes.

2. An arrangement according to claim 1, in which said oil channel is substantially parallel to a plane determined by the axes of said rivet holes.

3. An arrangement according to claim 2, in which said oil channel is located between said plane and said opening of said oil guide.

4. An arrangement according to claim 1, in which said oil channel extends substantially straight, and in which said ends of said oil channel lie on opposite sides of a plane determined by the axes of said rivet holes.

5. An arrangement according to claim 1, said one end of said oil channel terminating approximately at a vertical plane passing through the axis of said one rivet hole and said other end of said oil channel terminating approximately at a vertical plane passing through the axis of said other rivet hole.

6. An arrangement according to claim 1, in which said oil channel is spaced from said rivet hole.

7. An arrangement according to claim 1, in which said rivets delimit said oil channels radially inwardly.

8. An arrangement according to claim 1, in which said oil guide tapers in wedge shape from said inlet opening toward said one rivet hole.

9. An arrangement according to claim 1, in which the narrowest cross section of said oil guide is greater than the cross section of said oil channel.

10. An arrangement according to claim 1, in which said oil channel includes two end regions, each of which has an end, said end regions of said oil channel respectively embracing an associated rivet hole along a quarter of a circle, said ends terminating at the plane determined by the axes of said rivet holes.

11. An arrangement according to claim 1, in which the area between two rivet holes on said connecting member is provided with a groove on that side thereof which faces said chip-removing members, said last-mentioned groove being in communication with said oil channels of two chip-removing members for supplying lubricant thereto.

12. An arrangement for lubricating the saw chain of a power-driven chain saw having a guide bar for accommodating and guiding the saw chain, the saw chain including chip-removing members, cutting-tooth members, and connecting members, all of which are respectively provided with two rivet holes, said members being interconnected in a specific pattern by means of rivets and said rivet holes to form rivet connections, said chip-removing members having respective extensions which run in the guide bar provided with an oil supply for lubricating the saw chain, the arrangement comprising:

at least one groove defining an oil guide formed in the side surface of each of said chip-removing members, the oil guide having an inlet opening communicating with the oil supply, the oil guide being disposed in said surface to extend counter to the running direction of the saw chain and to extend at an angle upwardly toward one of the rivet holes;

each of said chip-removing members further having at least one oil channel formed in said side surface and communicating with the end of said oil guide remote from said inlet opening; said oil channel of each of said chip-removing members being disposed at least in part in the vicinity of at least one of said rivet holes and being at least partially covered by a member of the saw chain connected to the chip-removing member; and, said at least one oil channel being a full circle surrounding the rivet hole associated therewith.

13. An arrangement for lubricating the saw chain of a power-driven chain saw having a guide bar for accommodating and guiding the saw chain, the saw chain including chip-removing members, cutting-tooth members, and connecting members, all of which are respectively provided with two rivet holes, said members being interconnected in a specific pattern by means of rivets and rivet holes to form rivet connections, said chip-removing members having respective extensions which run in the guide bar provided with an oil supply for lubricating the saw chain, the arrangement comprising:

at least one groove defining an oil guide formed in the side surface of each of said chip-removing members, the oil guide having an inlet opening communicating with the oil supply, the oil guide being disposed in said surface to extend counter to the running direction of the saw chain and to extend at an angle upwardly toward one of the rivet holes;

each of said chip-removing members further having at least one oil channel formed in said side surface and communicating with the end of said oil guide remote from said inlet opening; said oil channel of each of said chip-removing members being at least partially covered by a member of the saw chain connected to the chip-removing member;

said oil channel being circular and disposed in surrounding relationship to said one rivet hole; and, a second circular channel disposed in surrounding relationship to said other one of said rivet holes; and, said chip-removing member being further provided with a short oil supply channel which interconnects said two oil channels.

14. An arrangement for lubricating the saw chain of a power-driven chain saw having a guide bar for accommodating and guiding the saw chain, the saw chain including chip-removing members, cutting-tooth members, and connecting members, all of which are respectively provided with two rivet holes, said members being interconnected in a specific pattern by means of rivets and said rivet holes to form rivet connections, said chip-removing members having respective extensions which run in the guide bar provided with an oil supply for lubricating the saw chain, the arrangement comprising:

at least one groove defining an oil guide formed in the side surface of each of said chip-removing members, the oil guide having an inlet opening communicating with the oil supply, the oil guide being disposed in said surface to extend counter to the running direction of the saw chain and to extend at an angle upwardly toward one of the rivet holes;

each of said chip-removing members further having at least one oil channel formed in said side surface and communicating with the end of said oil guide remote from said inlet opening; said oil channel of each of said chip-removing members being at least partially covered by a member of the saw chain connected to the chip-removing member; and, said oil channel having an arcuate shape in the form of a semicircle and being located in surrounding relationship to said one rivet hole, the ends of said channel terminating approximately at a vertical plane extending perpendicularly to the direction of movement of the saw chain along the guide bar and passing through the axis of said one rivet hole.

* * * * *